US011346638B1

(12) United States Patent
Sanderson et al.

(10) Patent No.: US 11,346,638 B1
(45) Date of Patent: May 31, 2022

(54) CAMOUFLAGE MATERIAL

(71) Applicant: CAMOSYSTEMS LIMITED, Christchurch (NZ)

(72) Inventors: Wayne Sanderson, Christchurch (NZ); Michael Price, Virginia (AU)

(73) Assignee: CAMOSYSTEMS LIMITED, Christchurch (NZ)

( * ) Notice: Subject to any disclaimer, the term of this patent is extended or adjusted under 35 U.S.C. 154(b) by 0 days.

(21) Appl. No.: 17/132,518

(22) Filed: Dec. 23, 2020

(51) Int. Cl.
*F41H 3/02* (2006.01)

(52) U.S. Cl.
CPC ..... *F41H 3/02* (2013.01)

(58) Field of Classification Search
None
See application file for complete search history.

(56) References Cited

U.S. PATENT DOCUMENTS 5,281,460 A * 1/1994 Cox ..... F41H 3/02 428/17
6,851,126 B1 * 2/2005 Humphreys ..... A41D 13/00 2/243.1
2008/0282440 A1 * 11/2008 Larson ..... F41H 3/02 2/243.1

* cited by examiner

*Primary Examiner* — Laura C Powers
(74) *Attorney, Agent, or Firm* — Saliwanchik, Lloyd & Eisenschenk

(57) ABSTRACT

The present invention relates to a camouflage material, in particular an artificial camouflage material intended for hunting and animal observation.

20 Claims, 5 Drawing Sheets

CAMOUFLAGE MATERIAL

TECHNICAL FIELD

The present invention relates to a camouflage material, in particular an artificial camouflage material intended for hunting and animal observation.

BACKGROUND ART

Camouflage materials have been used to create blinds (hides or machans) to hide or obscure hunters or observers of wildlife for a long time. A blind may be stationary/fixed or mobile.

Some blinds are made of natural materials from the location where the blind is constructed, this form of blind requires skill to make as it needs to obscure and be mechanically stable. This form of natural material blind is often time consuming to construct and unable to be moved which means that it is often only suitable for a long term fixed location. As the natural materials used to construct a natural material blind will break down over time it can need annual, or more frequent replacement.

Given the skill and time required to construct natural material blinds most hunters and observers use artificial materials sometimes augmenting these with natural materials to obscure where the blind and natural environment join.

The most common forms of camouflage material are a printed flexible material (often cloth) or a net ('camo net') which is a net material often with pieces of coloured material attached to it. The printed forms of camouflage are not three dimensional and though some attempt to imitate this with printing techniques they can lack realism if wrongly used.

Some camouflage materials incorporate additional elements attached to the surface to create a three-dimensional material. Unfortunately they are still sheets of material that drape and hang which may leave edges and surfaces that do not match the environment.

Some of the camouflage cloths and nets have repeating patterns and many have straight edges which need to be obscured or broken up. This is especially true for camouflaging boats and the like.

The normal method for attaching individual camouflage elements to a backing strip is to sew these into place, this sewing has been used for a long time to attach natural materials to cotton or other backing materials.

To provide a three-dimensional material natural materials such as grasses and palm leaves have been sewn together, often by hand to produce grass mats. In use the natural materials used for the grass mats degrade and need replacing, normally within 4 to 6 months, this can make them inconvenient, wasteful and/or costly to use.

To increase the longevity of the grass mats some of these three-dimensional camouflage materials have started to use synthetic materials. These synthetic grass mats are assembled the same way, that is, sewing is used to attach synthetic material camouflage to a synthetic backing/attachment strip. This sewing process punches holes though the material and pulls a thread through the hole, then tensions the thread to attach the component parts together. This sewing process can lead to stress points in the synthetic material, especially if the thread tension is not controlled, and these stress points can cause premature failure of the camouflage. In addition, if the thread material is not carefully chosen to be compatible, the thread can also accelerate the breakdown of some synthetic materials. In addition in certain environments with high UV exposure levels the UV and stress concentration around the holes can cause premature failure of the synthetic material or the thread can break down unless carefully chosen.

Any discussion of the prior art throughout the specification is not an admission that such prior art is widely known or forms part of the common general knowledge in the field.

It is an object of the present invention to provide a camouflage material that can ameliorate at least one of the deficiencies in current camouflage materials or at least provide a consumer with a useful choice.

DISCLOSURE OF INVENTION

The present invention provides a camouflage material including an attachment strip with a first attachment face and a second attachment face to which a plurality of first grass strips and second grass strips are attached, the first grass strips lie immediately adjacent to the first attachment face and the second grass strips lie immediately adjacent the second attachment face wherein:

- each grass strip lies perpendicular to the attachment strip;
- each grass strip and the attachment strip are a synthetic material;
- each grass strip is double sided with a primary grass side and a secondary grass side;
- each grass strip has an independently chosen grass marking on each side, where the grass marking is the palette of colours and pattern which creates the visual appearance of that side;
- the specific combination of grass marking that a single grass strip has is a grass marking combination;
- the grass strips are directly or indirectly attached to the immediately adjacent attachment face by welding or gluing; and
- the camouflage material includes grass strips with at least four different grass marking combinations;

such that:

- the distance each grass strip extends away from a first attachment edge of the attachment strip is independently and essentially randomly selected from the range of 25 mm (1") to 150 mm (6");
- each first grass strip overlaps the immediately adjacent first grass strip by between 10% and 90%;
- each second grass strip overlaps the immediately adjacent second grass strip by between 10% and 90%; and
- the grass strips are all essentially the same length.

Preferably the synthetic material that the grass strips and the attachment strip are made of is a polyethylene. In a highly preferred form the grass strips are made from high density polyethylene. Preferably both the grass strips and the attachment strip are made from high density polyethylene. In an alternative preferred form the grass strips and attachment strip are made from independently selected combinations of low, medium and high density polyethylene.

Preferably the grass strips are attached to the attachment strip by welding. Preferably the welding used is high frequency or ultrasonic welding. Preferably the welding forms an attachment weld.

Preferably the attachment weld is made up of a plurality of short weld sections. Preferably the weld sections are short straight welds. Preferably the weld sections are at an angle of 25° to 65° to the attachment strip. In an alternative preferred from the weld sections are circular or oval in shape. Preferably some of the weld sections attach grass strips to other grass strips without attaching them to the attachment strip.

Preferably the number of grass marking combinations is between 4 and 20. In a highly preferred form the number of grass marking combinations is between 4 and 10.

Preferably the camouflage material has a first camouflage face and a second camouflage face which have different visual appearances, the first camouflage face is a face of the camouflage material seen when the first attachment face is facing an observer and the second camouflage face is a face of the camouflage material seen when the second attachment face is facing an observer. In one preferred form the first camouflage face and second camouflage face have a visual appearance optimised for different seasons in a specific geographical location. In an alternative preferred form the first camouflage face and second camouflage face have a visual appearance optimised for different geographical locations. In another preferred form the first camouflage face and second camouflage face have a visual appearance optimised for different environments.

Preferably there is a single attachment strip. In an alternative form the attachment strip is two or more narrow strips of material all lying adjacent and essentially parallel to one another.

Preferably the length of each grass strip is from 24" (78 cm) to 96" (315 cm) in length, the length of each grass strip being independently chosen from this range.

BRIEF DESCRIPTION OF DRAWINGS

By way of example only, a preferred embodiment of the present invention is described in detail below with reference to the accompanying drawings, in which.

Please note that the drawings are pictorial representations they are not engineering drawings and as such they are not to any scale, further the relative dimensions and shapes may be exaggerated or simplified for clarity.

The capital letter of lowercase 'i' is not used in a numbered list or item identifier to avoid confusion with lowercase 'L', similarly the capital letter 'O' is not used to avoid confusion with the number 0 (zero).

Definitions

Grass Strip: in this specification a grass strip is a thin elongate member with a simulated grass or reed pattern applied to each side/face. Each grass strip is double sided, that is the colours, saturation of the colours, intensity of the colours or combination of colours is different on each side or face. These grass strips are sometimes known as 'Synthetic Rattan Flat Reeds' or when the polymer used is polyethylene 'PE Rattan'. It is intended that this term covers the synthetic rattan flat reeds that have a coloration and/or pattern that is an imitation of the natural colouration/pattern/look of reed, rattan reeds or grasses.

High Frequency (HF) Welding: This is intended to include Ultrasonic, microwave, dielectric and radio frequency welding technology normally used for plastic welding.

Pattern: in relation to the grass strip this term is meant to cover both a pattern of colours and three-dimensional surface patterns alone or in combination.

Perpendicular: in this specification the term perpendicular is intended to refer to 90°+/−5° unless otherwise specified and, essentially perpendicular is intended to cover the range of 90°+/−10°.

BEST MODE FOR CARRYING OUT THE INVENTION

Figure 1:
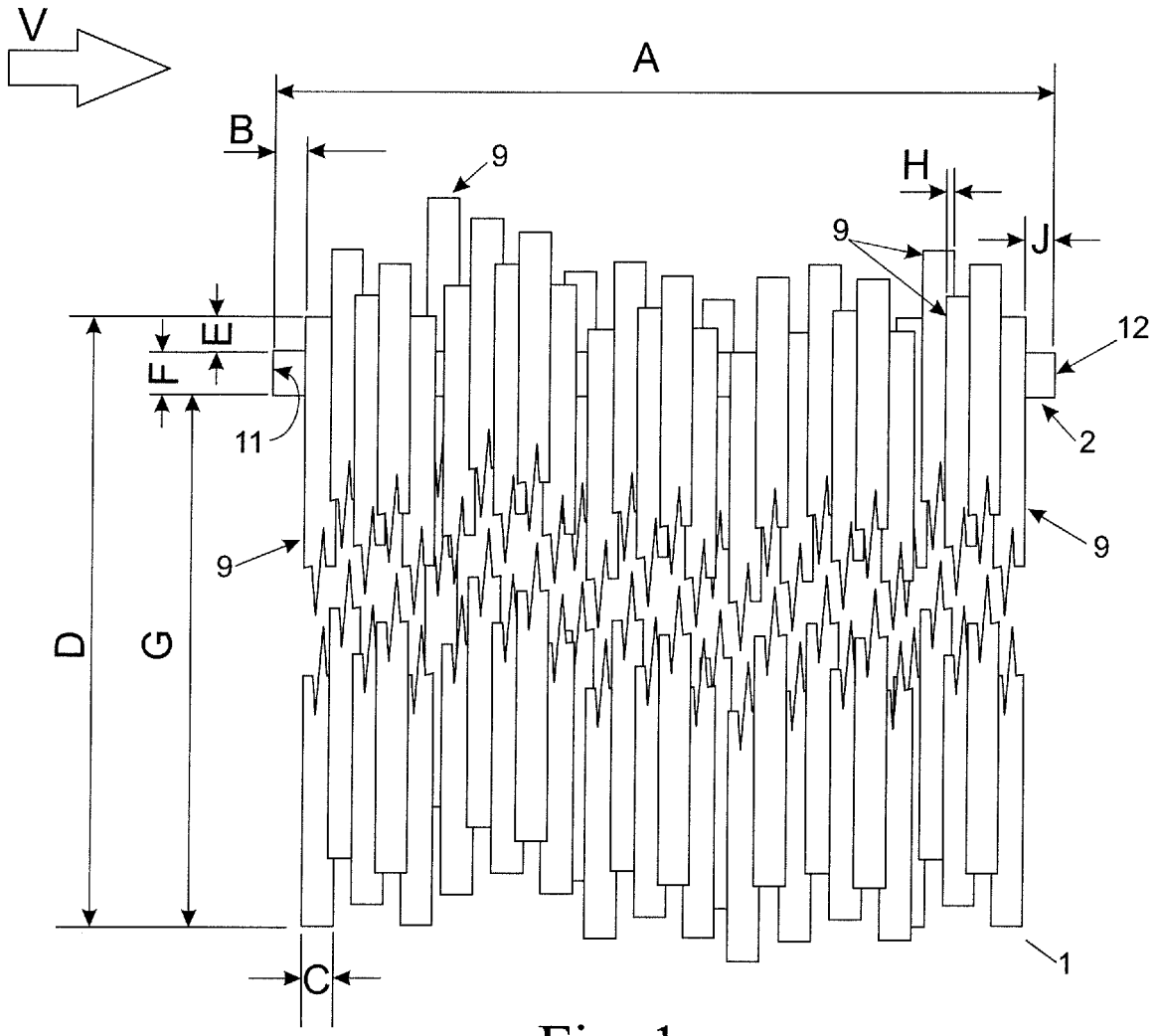
FIG. 1 Is a front view of the camouflage material.
Figure 2:
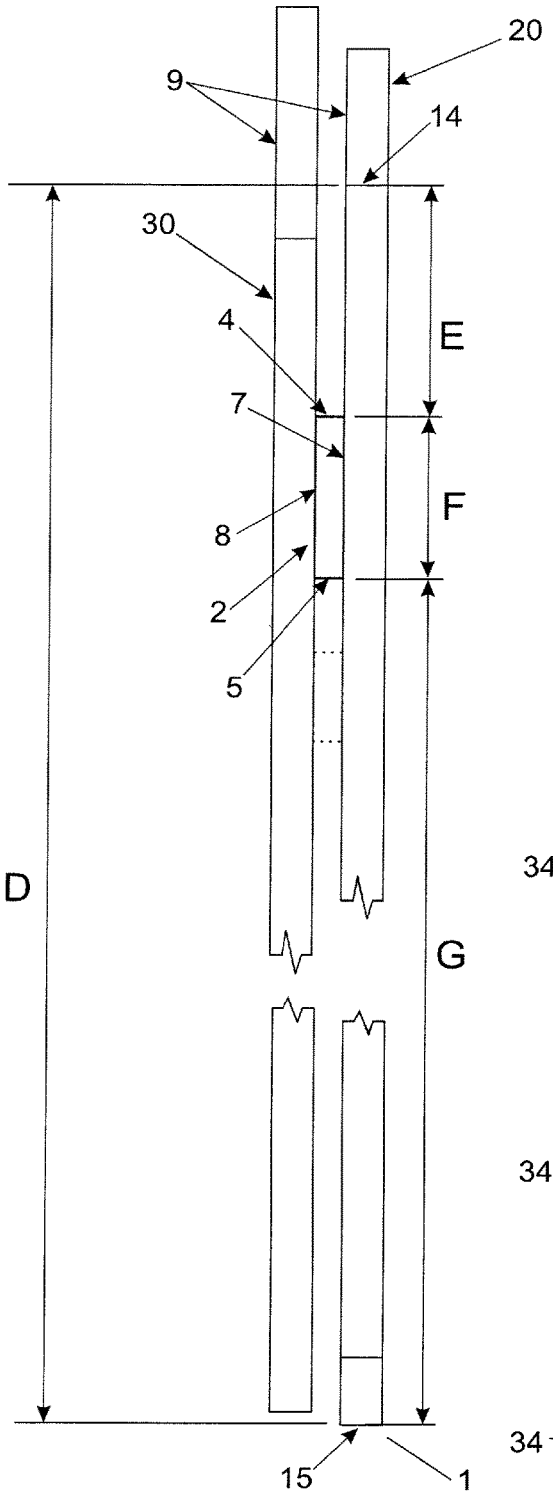
FIG. 2 is an end view of the camouflage material when viewed in the direction indicated by arrow V.

Referring to FIG. 1 and FIG. 2 a section of camouflage material (1) is shown in front view and end view in the direction of arrow V. The camouflage material (1) includes an attachment strip (2) with two attachment edges (4,5) and two attachment faces (7,8) attached to a plurality of perpendicularly aligned grass strips (9).

The attachment strip (2) is a thin elongate member of a synthetic material. It is preferred that the attachment strip (2) is a polyethylene or a polyethylene blend as the preferred form of grass strip (9) is a polyethylene synthetic rattan flat reed as this has the required environmental properties.

As shown in FIG. 2, the attachment edges (4,5), the first attachment edge (4) and the second attachment edge (5), are the opposite longitudinally aligned edges of the attachment strip (2). The attachment faces (7,8), the first attachment face (7) and the second attachment face (8), are the faces of the attachment strip (2) to which the grass strips (9) are attached. The attachment strip (2) further includes a first terminal end (11), and a second terminal end, (12) which are the opposite longitudinally separated terminal ends of the attachment strip (2).

As shown in FIG. 2, grass strips (9) are attached to both attachment faces (7,8) with first grass strips (20) immediately adjacent and attached to the first attachment face (7) and second grass strips (30) immediately adjacent and attached to the second attachment face (8).

Referring to FIGS. 1 and 2 the following letters represent the dimensions indicated below:

A. the length of the attachment strip (2);

B. the distance between the first terminal end (11) of the attachment strip (2) and the closest edge of the closest immediately adjacent grass strip (9,20,30);

C. is the width of a grass strip (9,20,30);

D. is the length of a grass strip (9,20,30);

E. is the distance from one terminal end, the primary terminal end (14), of a grass strip (9,20,30) to the first attachment edge (4);

F. width of attachment strip;

G. is the distance from a terminal end, the secondary terminal end (15), of a grass strip (9,20,30) to the second attachment edge (5), the primary terminal end (14) and secondary terminal end (15) are opposite terminal ends of the same grass strip (9,20,30);

H. is the distance that two immediately adjacent grass strips (9) attached to the same attachment face (7,8) overlap; and J. the distance between the second terminal end (12) of the attachment strip (2) and the closest edge of the closest immediately adjacent grass strip (9,20,30).

The length of the attachment strip (2), A, is not felt critical as it depends on the intended purpose, and if the camouflage material (1) is provided in roll form the maximum length could be 100 m ('330 ft) or more depending on the roll size. It is expected that most separate camouflage material (1) items will be in the range 61 cm (24")<A<244 cm (96")

The length of exposed attachment strip (9,20,30), B and J, may be 0 cm (0") to 30 cm (10"). If a section of camouflage material is cut from a roll it is most likely to be 0 (zero) and if it is part of a separately manufactured camouflage material (1) item then it is used as a means of connecting/attaching (releasably or permanently) that item in place. In some variants this may be longer to allow for damage or specific purposes, this dimension is not particularly critical.

The width of each grass strip (9,20,30), C, is determined by the manufacturer of the source material used, most commonly it is between 5 mm (3/16") and 13 mm (½") though it could be up to 25 mm (1").

The length of each grass strip (9,20,30), D, for a particular piece of camouflage material (1) is expected to be essentially the same and be in the range of 61 cm (24") to 163 cm (64"). Some variants for specific purposes may extend this to 244 cm (96").

The distance each grass strip (9,20,30) extends away from the attachment strip (2), E, is independently and essentially randomly chosen for each grass strip (9,20,30) in the range of 25 mm (1") to 150 mm (6") though in most cases 25 mm (1")<E<100 mm (4"). This provides an uneven edge outline to the camouflage material (1). The lower values of E make the grass strip (9,20,30) stiffer which imitates dry material or the broken ends of reed and grass, whereas the larger values of E allow the grass strip (9,20,30) to bend and move in the wind matching natural reeds or grass, this combination further breaking up the outline and increasing the realism.

The width of the attachment strip (2), F, is not felt critical it merely needs to be wide enough to securely attach the grass strip (9,20,30) and, where the attachment strip (2) extends away from the terminal grass strips (9,20,30), allow the camouflage material (1) to be attached in use. Most likely 25 mm (1")<F<75 mm (3") though for added flexibility this may extend down to 13 mm (½"). There may be more than one attachment strip (2) but this is not shown and it may reduce the effectiveness of the camouflage material (1).

The length of the grass strip (9,20,30) extending away from the attachment strip (2) to the secondary terminal end (15), G, is simply D−(E+F)=G.

The overlap between immediately adjacent grass strips (9,20,30) attached to the same attachment face (7,8) of the attachment strip (2), H, is in the range of 10% to 90% of C, i.e. 0.1 C<H<0.9 C.

Figure 3:
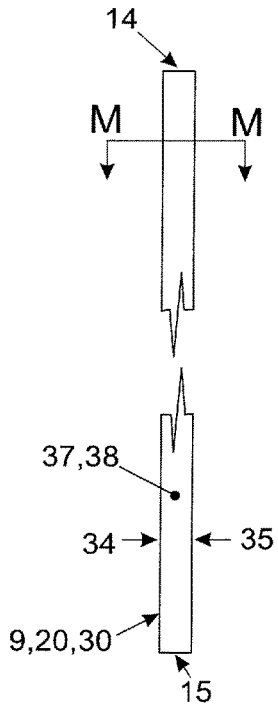
FIG. 3 is a front view of one grass strip.

Referring to FIG. 3 a grass strip (9,20,30) is shown with two grass edges (34,35), a primary grass edge (34) and a secondary grass edge (35), and two grass sides (37,38), a primary grass side (37) and a secondary grass side (38). The grass edges (34,35) are the longitudinally aligned opposite edges of the grass strip (9,20,30). The grass sides (37,38) are the longitudinally aligned opposite faces of the grass strip (9,20,30) that are immediately adjacent the grass edges (34,35).

Figure 4:
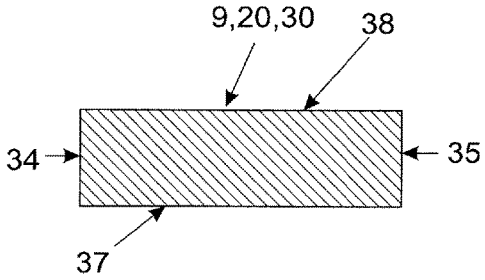
FIG. 4 is a cross-sectional view of the grass strip shown in FIG. 3 along the line M-M in the direction of the arrows.
Figure 5A:
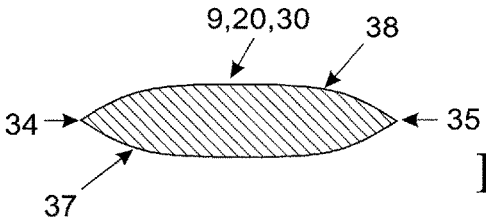
FIGS. 5A-5B are cross sectional views of two alternative cross-sections of the grass strip shown in FIG. 3 along the line M-M in the direction of the arrows, variants (5A) and (5B)
Figure 5B:
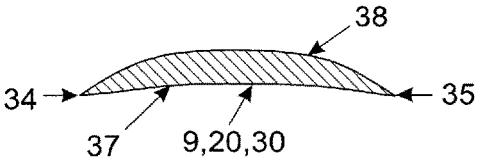

FIG. 3 also shows a cross sectional line M-M extending across the width of the grass strip (9,20,30). FIGS. 4 and 5 show two possible variations of the cross-section of the grass strip along line M-M in the direction of the arrows, these are meant to be non-limiting examples only.

Referring to FIG. 4 the cross-sectional shape of the grass strip (9,20,30) is essentially rectangular, with the primary and secondary grass edges (34,35) being two opposite faces of the rectangle with the primary and secondary grass sides (37,38) being the remaining two opposite faces of the rectangle.

Referring to FIG. 5 the cross-sectional shape of the grass strip (9,20,30) has two curved faces, in FIG. 5 (*a*) these are both convex and in FIG. 5 (*b*) one is convex and the other is concave. The two curved faces, the primary and secondary grass sides (37,38), terminate at longitudinally opposed vertices, one vertex being coterminous with the primary edge (34) and the remaining opposite vertex being coterminous with the secondary edge (35). This cross-section is intended to be closer to the cross-section of natural grass, reed or rattan reed.

Referring to FIG. 1 or 2 each grass strip (9,20,30) is attached to the attachment strip (2) and any overlapped grass strips (9,20,30) by welding (high frequency or similar) or gluing, though welding is preferred.

Figure 6:
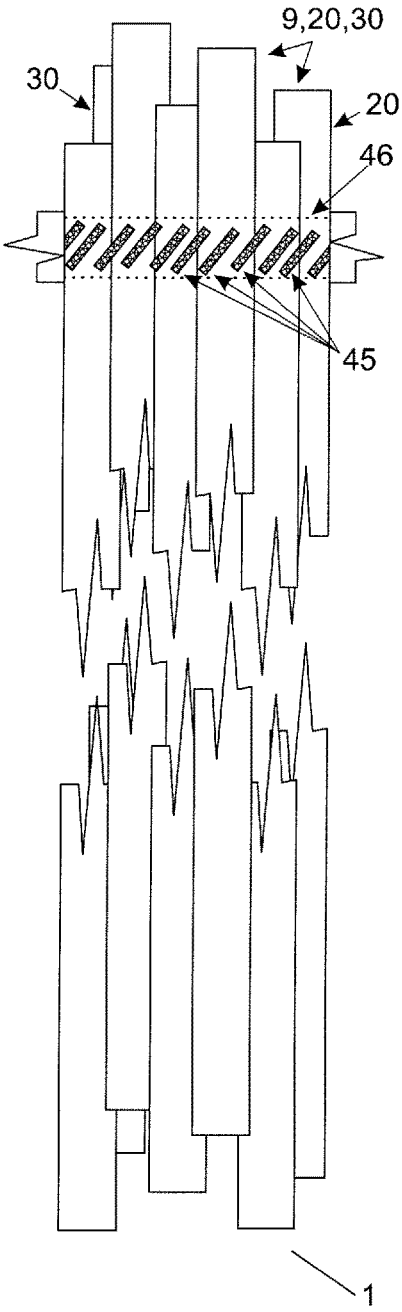
FIG. 6 is a section of camouflage material in front view enlarged to show one variation of a welding pattern used to attach the grass strips to the attachment strip.
Figure 7D:
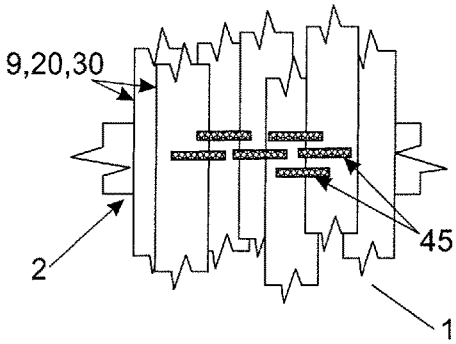
FIGS. 7A-7D are series of front views of a section of the camouflage material showing welded sections shape variants.
Figure 7C:
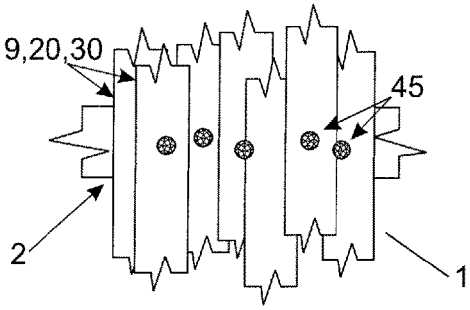
Figure 7B:
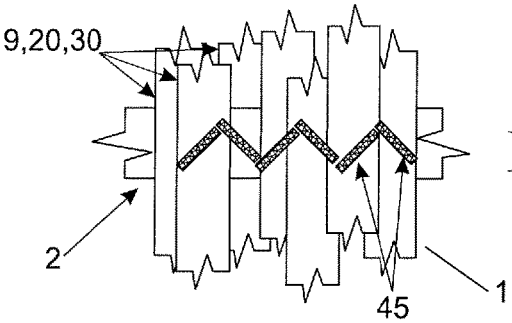
Figure 7A:
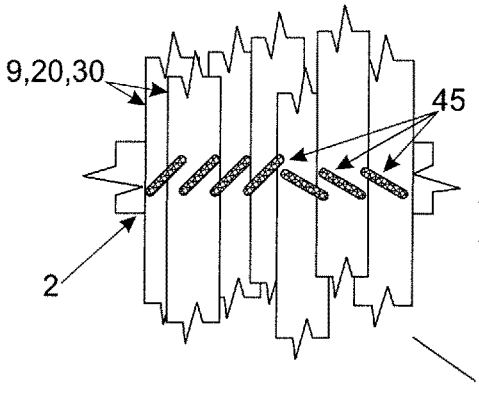

If welding is used to attach the grass strips (9,20,30) to the attachment strip (2) and any intervening grass strips (9,20,30) then the weld will also extend through to any grass strip (9,20,30) attached to the opposite attachment face (7,8). Referring to FIG. 6 one variation of attachment using welding is shown, in this variant the welding is a series of short angled discontinuous welds, welded sections (45) with a matt or non-reflective surface. The combination of the welded sections (45) make up an attachment weld (46) (shown in dashed lines) and they are believed to maintain the flexibility of the attachment strip (2) and camouflage material (1) as well as avoid continuous features that affect the effectiveness of the camouflage material (1). As shown each welded section (45) may not extend the full width of a grass strip (9,20,30), even though it overlaps a portion of an adjacent grass strip (9,20,30). A plurality of welded sections (45) may attach the same grass strip (9,20,30) to the attachment strip (2). In some variants particular welded sections (45) may not extend through the thickness of the camouflage material (1), for example attaching either the first grass strips (20) or the second grass strips (30) to the attachment strip (2) but not the second grass strip (30) or first grass strip (20) respectively. This partial penetration weld section (45) may provide additional flexibility to the camouflage material (1). These partial penetration welded sections (45) can be accomplished by adjusting settings on the welder, for example the time the welding tip (not shown) is held in contact and/or adjusting the power output of the welding tool (not shown) can affect the penetration depth of a weld. It is believed that it is optimum if linear weld sections (45) are used that these will optimally be at an angle of between 25° and 65° to the attachment strip (2) though any angle is likely to work providing the weld section (45) length and spacing allows the camouflage material (1) to roll up.

Each grass strip (9,20,30) is double sided with a different colour, intensity, palette, saturation of colours, lightness or pattern variation on each grass side (37,38). This different marking ('grass marking') on each grass side (37,38) means that by reversing some of the grass strips (9,20,30) a variation in marking along the length of the attachment strip (2) occurs. This variation in exposed marking along the length of the camouflage material (1) increases the realism of the camouflage material (1). It has been found that using grass strips (9,20,30) with different marking combinations, at least four, achieves sufficient realism. Some of the grass strips (9,20,30) show the reverse side to the immediately adjacent grass strip (9,20,30) and some colours/grass markings may only be used infrequently, the aim is to provide a camouflage material (1) that imitates the natural environment in use. In most cases between 4 and 10 different colours/grass marking of grass strip will be used.

As the camouflage material (2) has first and second grass strips (20,30) it provides a denser camouflage than the natural material variants or variants that have only first grass strips (20) present. In addition the outer most layer of grass strips (9,20,30) can be disturbed without necessarily compromising the effectiveness of the camouflage material (1), this can provide a more natural camouflage.

By choosing the colours of the grass strips carefully the camouflage material (1) can be made double sided, with one side adapted for one environment or season and the other for a second environment or season. This dual use camouflage material (1) is very difficult to create using natural materials.

Referring to FIG. 7 a number of variations ((a) to (d)) of the shape and configuration of the welded sections (45) are shown. These variants can be combined without deviating from the concept.

FIG. 7 variant (a) shows angled welded sections (45) with one group of welded sections (45) at one angle and a second group of welded sections (45) at an approximately mirror angle to the first. This pattern of groups of welded sections (45), a first group at one angle followed by a second group at an approximately mirror angle is repeated along the length of the attachment strip (2).

FIG. 7 variant (b) shows a pattern of angled welded sections (45) where each individual angled welded section (45) is followed by an angled welded section (45) at a mirror angle.

FIG. 7 variant (c) shows a series of spot (circular) welded sections (45).

FIG. 7 variant (d) shows welded sections (45) that are approximately parallel and aligned with the length of the attachment strip (1).

Referring to FIG. 1 the attachment strip (2) is shown extending away from the terminal grass strips (9) a length J. This exposed portion of the attachment strip (2) is provided to allow the camouflage material to be attached to a supporting structure (not shown). As such the exposed length of attachment strip (2) may be a length of double sided hook and loop connector.

Figure 8:
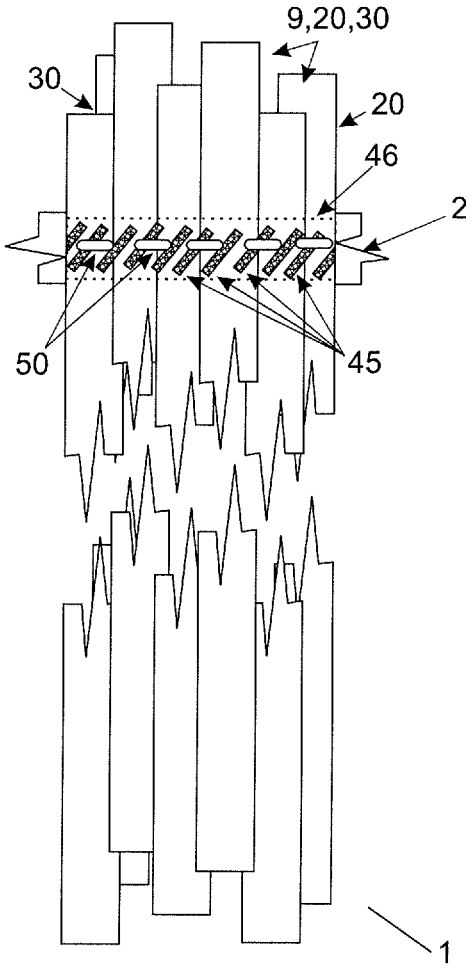
FIG. 8 is a section of camouflage material in front view enlarged to show one variation of attachment holes.
Figure 9:
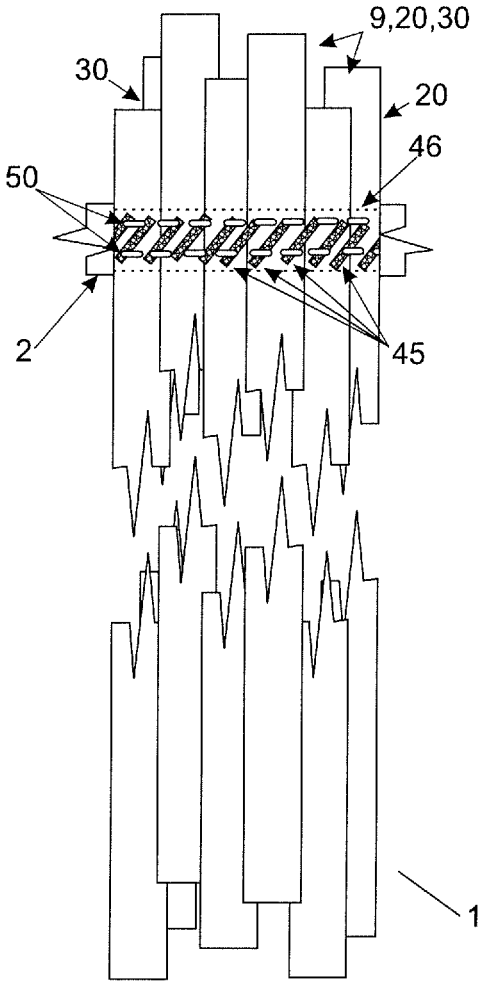
FIG. 9 is a section of camouflage material in front view enlarged to show a second variation of attachment holes.
Figure 10:
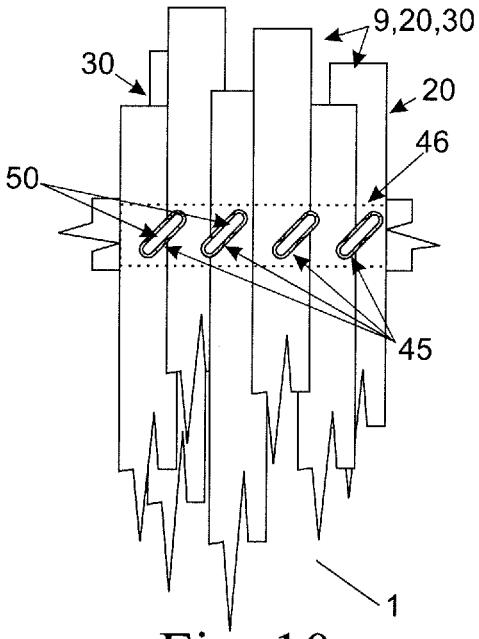
FIG. 10 is a section of camouflage material in plan view enlarged to show a variation where the attachment holes are integral with the welded sections.

As shown in FIGS. 8 and 9 to aid in attaching the camouflage material (1) some variants include attachment holes (50) that extend through the grass strips (9,20,30) and attachment strip (2) where they are attached together. Each attachment hole (50) is a void with an aperture in each of the exposed faces of the first and second grass strips (20,30) through which it passes. The attachment holes (50) shown are obround in cross section but they may have any suitable cross-section, including, but not limited to, polygons, polygons with one or more sides replaced by curves, circular, oval or any shape made up of only curves. The pattern of attachment holes shown in FIG. 8 is a single row of obround attachment holes which are longitudinally aligned and in FIG. 9 two series of parallel longitudinally aligned attachment holes (50) are shown. In some variants, see FIG. 10, the attachment holes (50) are integrated with the welded sections (45).

Figure 11:
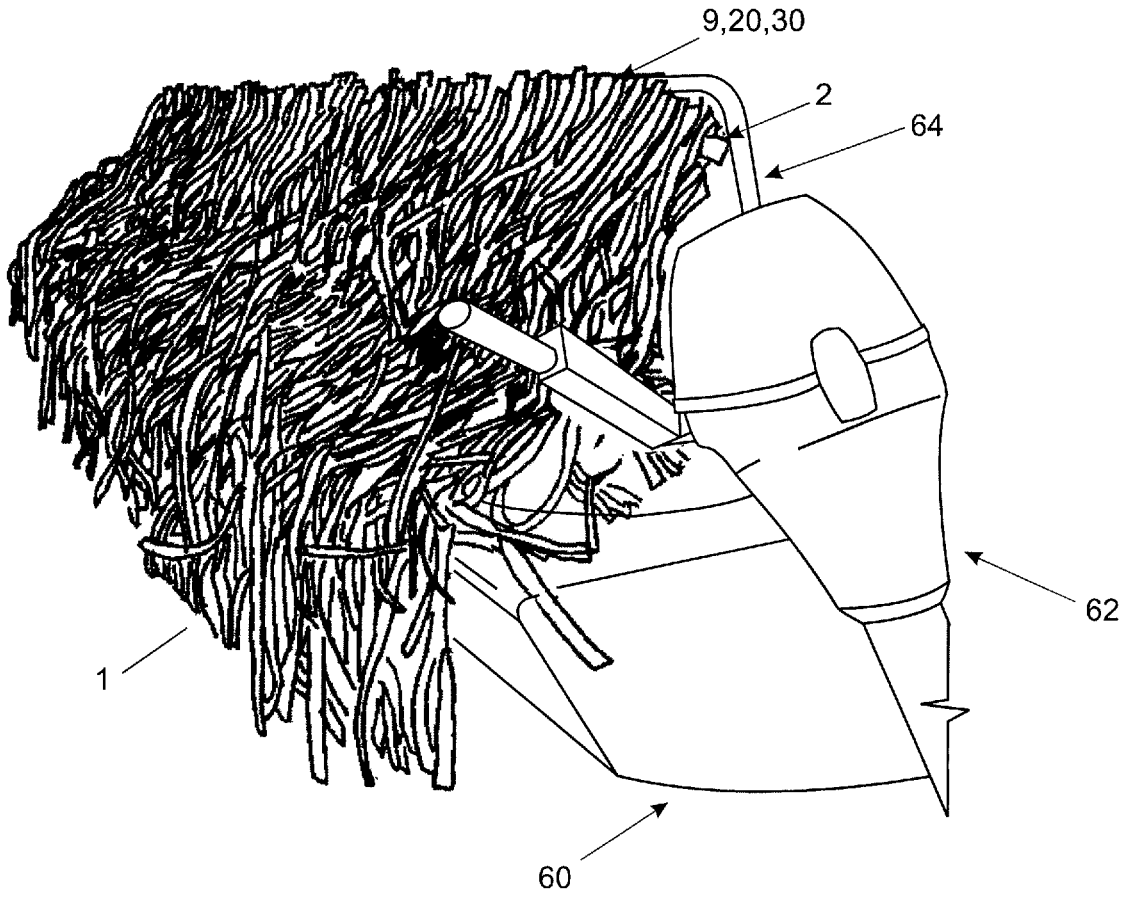
FIG. 11 is a partial pictorial view of the camouflage material on a boat.

Referring to FIG. 11 a partial pictorial view of the camouflage material mounted on a boat (60) with an outboard motor (62) and tubular support (64) is shown. As can be seen with the grass strips (9,20,30) attached to both sides of the attachment strip (2) with essentially random lengths of the grass strips (9,20,30) extending above the attachment strip (2) the outline of the tubular support (64) is obscured as is the interior of the boat (60). It can be seen that some of these extended sections bend and some have stayed straight this matches nature and increases the realism of the camouflage material (1). A single layer of grass strips (9,20,30) would leave gaps and voids which would reveal the interior of the boat (60). If the grass strips (9,20,30) had been sewn to the attachment strip (2) it would leave an essentially liner feature extending along the length of the camouflage material (1) (not shown) which could have affected the effectiveness as camouflage.

In some variants first and second grass strips (20,30) may be attached together at points where they do not overlap the attachment strip (2).

In some variants, for example where the camouflage material (1) is provided in rolls, B and/or J may be 0 (zero) as the customer cuts off the length required.

KEY

1 camouflage material,
2 attachment strip;
4 first attachment edge; (the one from which E is measured)
5 second attachment edge; (the one from which G is measured)
7 first attachment face;
8 second attachment face;
9 grass strips;
11 first terminal end of the attachment strip;
12 second terminal end of the attachment strip;
14 Primary terminal end; (one terminal end of a grass strip)
15 Secondary terminal end; (terminal end of a grass strip, opposite end to 14)
20 first grass strips; (attached to first attachment face)
30 second grass strips; (attached to second attachment face)
34 primary grass edge (of grass strip);
35 secondary grass edge (of grass strip);
37 primary grass side;
38 secondary grass side;
45 welded sections;
46 weld;
50 attachment holes;
60 boat;
62 outboard motor;
64 tubular support;

The invention claimed is:

1. A camouflage material including an attachment strip with a first attachment face and a second attachment face to which a plurality of first grass strips and second grass strips are attached, the first grass strips lie immediately adjacent to the first attachment face and the second grass strips lie immediately adjacent the second attachment face wherein:

each grass strip lies perpendicular to the attachment strip;

each grass strip and the attachment strip are a synthetic material;

each grass strip is double sided with a primary grass side and a secondary grass side;

each grass strip has an independently chosen grass marking on each side, where the grass marking is a palette of colours and patterns which creates a visual appearance of a grass or reed on that side;

the specific combination of the grass marking applied to the primary grass side and the grass marking applied to the secondary grass side of a single grass strip is a grass marking combination;

the grass strips are directly or indirectly attached to the immediately adjacent attachment face by welding or gluing; and the camouflage material includes grass strips with at least four different grass marking combinations;

such that:

the distance a portion of each grass strip extends away from a first attachment edge of the attachment strip is independently and randomly selected to be between 1" (25 mm) and 6" (150 mm);

each first grass strip overlaps the immediately adjacent first grass strip by between 10% and 90%;

each second grass strip overlaps the immediately adjacent second grass strip by between 10% and 90%; and the grass strips are all the same length.

2. The camouflage material as claimed in claim 1, wherein the synthetic material that the grass strips and the attachment strip are made of is a polyethylene.

3. The camouflage material as claimed in claim 2, wherein the grass strips and/or the attachment strip are made from high density polyethylene.

4. The camouflage material as claimed in claim 1, wherein the length of each grass strip is from 24" (61 cm) to 96" (244 cm) in length.

5. The camouflage material as claimed in claim 2, wherein each of the grass strips are independently made from low density polyethylene, medium density polyethylene, high density polyethylene, or combinations thereof.

6. The camouflage material as claimed in claim 1, wherein the grass strips are attached to the attachment strip by welding to form an attachment weld.

7. The camouflage material as claimed in claim 6, wherein the welding used is high frequency or ultrasonic welding.

8. The camouflage material as claimed in in claim 6, wherein the attachment weld is made up of a plurality of short welded sections.

9. The camouflage material as claimed in claim 8, wherein the welded sections are short straight welds.

10. The camouflage material as claimed in claim 9, wherein the welded sections are at an angle of 25° to 65° to the attachment strip.

11. The camouflage material as claimed in claim 8, wherein the welded sections are circular or oval in shape.

12. The camouflage material as claimed in claim 8, wherein some of the welded sections attach grass strips to other grass strips without attaching them to the attachment strip.

13. The camouflage material as claimed in claim 1, wherein the number of grass marking combinations is between 4 and 20.

14. The camouflage material as claimed in claim 13, wherein the number of grass marking combinations is between 4 and 10.

15. The camouflage material as claimed in claim 1, wherein the camouflage material has a first camouflage face and a second camouflage face which have different visual appearances, the first camouflage face is a face of the camouflage material seen when the first attachment face is facing an observer and the second camouflage face is a face of the camouflage material seen when the second attachment face is facing an observer.

16. The camouflage material as claimed in claim 15, wherein the first camouflage face and second camouflage face have a visual appearance optimised for different seasons in a specific geographical location.

17. The camouflage material as claimed in claim 15, wherein the first camouflage face and second camouflage face have a visual appearance optimised for different geographical locations.

18. The camouflage material as claimed in claim 15, wherein the first camouflage face and second camouflage face have a visual appearance optimised for different environments.

19. The camouflage material as claimed in claim 1, wherein grass strips with similar grass marking exposed are not immediately adjacent each other.

20. The camouflage material as claimed in claim 2, wherein the attachment strip is made from low density polyethylene, medium density polyethylene, high density polyethylene, or combinations thereof.

* * * * *